US006374437B1

(12) United States Patent
Voelker

(10) Patent No.: US 6,374,437 B1
(45) Date of Patent: Apr. 23, 2002

(54) BED, SPECIALLY A MEDICAL OR CARE BED

(75) Inventor: Heinrich Voelker, Witten (DE)

(73) Assignee: Voelker Moebelproduktionsgesellschaft mbH, Witten (DE)

( * ) Notice: Subject to any disclaimer, the term of this patent is extended or adjusted under 35 U.S.C. 154(b) by 0 days.

(21) Appl. No.: 09/446,329

(22) PCT Filed: May 12, 1998

(86) PCT No.: PCT/EP98/02757

§ 371 Date: Dec. 21, 1999

§ 102(e) Date: Dec. 21, 1999

(87) PCT Pub. No.: WO98/58570

PCT Pub. Date: Dec. 30, 1998

(30) Foreign Application Priority Data

Jun. 24, 1997 (DE) ..... 197 26 797

(51) Int. Cl.[7] ..... A47C 21/08

(52) U.S. Cl. ..... 5/600; 5/425; 5/426; 5/430

(58) Field of Search ..... 5/424, 425, 426, 5/427, 428, 429, 430, 93.1, 507.1, 658, 661, 659

(56) References Cited

U.S. PATENT DOCUMENTS 1,066,976 A * 7/1913 Atkinson ..... 5/426
4,811,436 A 3/1989 Schwartz
5,305,480 A * 4/1994 Loren et al. ..... 5/504.1
5,381,571 A 1/1995 Gabhart
5,640,726 A * 6/1997 Fichner-Rathus ..... 5/426

FOREIGN PATENT DOCUMENTS

| | | |
|---|---|---|
| DE | U1718671 | 3/1956 |
| DE | U7324686 | 9/1973 |
| DE | A14400802 | 7/1995 |
| GB | 1279081 | 6/1972 |

* cited by examiner

*Primary Examiner*—Lynne H. Browne
*Assistant Examiner*—Fredrick Conley
(74) *Attorney, Agent, or Firm*—Birch, Stewart, Kolasch & Birch, LLP

(57) ABSTRACT

A bed comprises a lower frame (12) having at least one leg or support element (16) for support on a ground and an upper frame (14) connected with the lower frame (12) and having a head element (22) and a foot element (24), as well as at least one connecting element (26) connecting the same. Further, a lying surface (46) having two longitudinal edges (48) extending between the head element (22) and the foot element (24), and at least one safety side element (52; 54) are provided, the at least one safety side element (52; 54) being slidable, beneath the lying surface (46), in a pull-out plane between an insert position and a maximum pull-out position. The at least one safety side element (52; 54) remains extending in the pull-out plane in any intermediate position between insert position and the maximum pull-out position. In its maximum pull-out position, it can be pivoted about a pivot axis (76) substantially parallel to the longitudinal edges (48) of the lying surface (46) into an upright position, a locking device (78) locking it against unintentional movement.

31 Claims, 9 Drawing Sheets

BED, SPECIALLY A MEDICAL OR CARE BED

Figure 1:
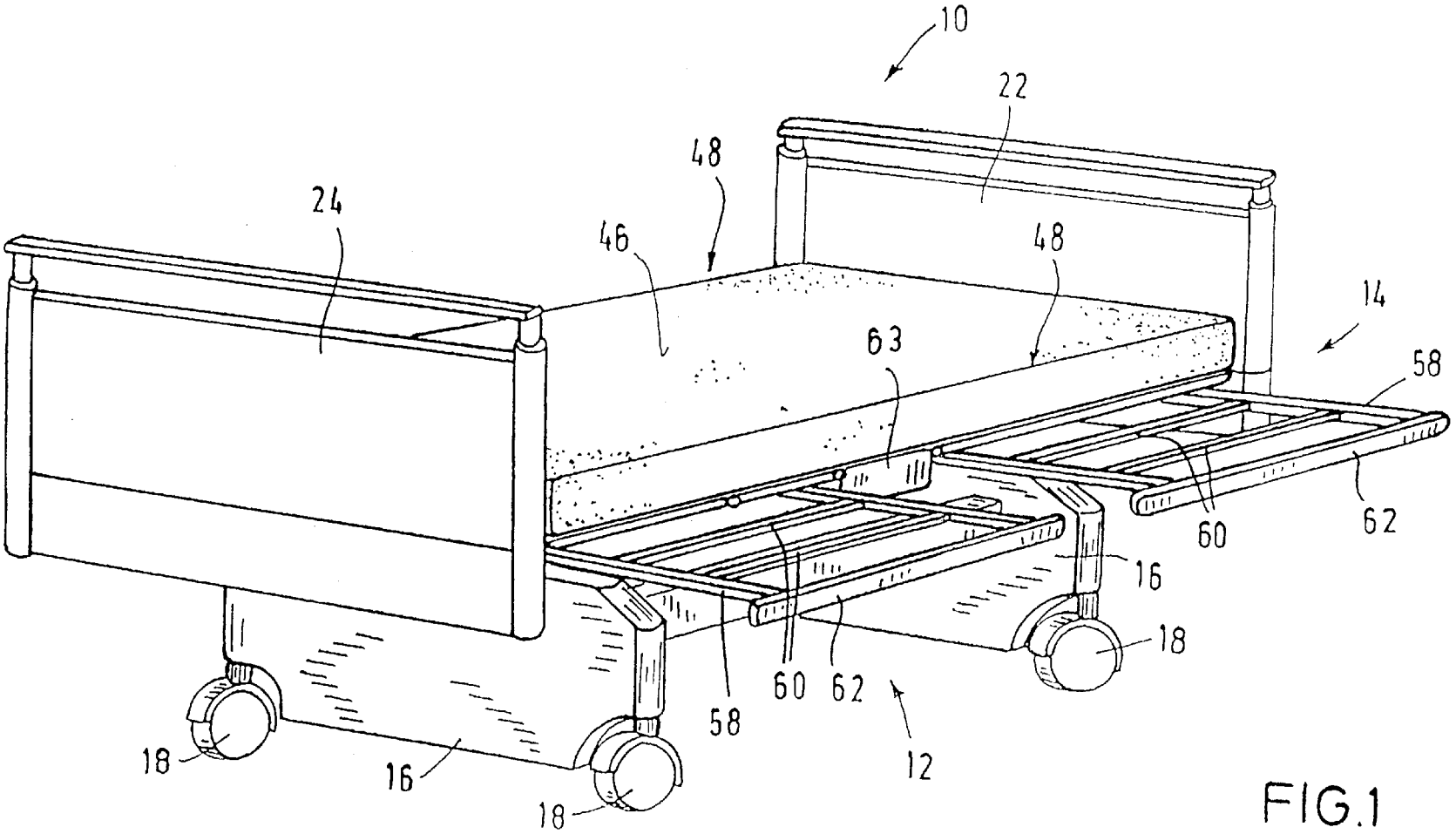

This application is the national phase under 35 U.S.C. §371 of PCT International Application No. PCT/EP98/02757 which has an International filing date of May 12, 1998 which designated the United States of America.

The present invention relates to a bed, in particular to a medical or care bed, which is provided with safety side elements for defining the lying surface laterally.

A bed of the above type is known form DE 44 00 802 A1. This known bed is provided with a movable lower frame on which an upper frame is arranged. The upper frame comprises a bed frame formed by a head element, a foot element and two side elements. Disposed in the frame is a preferably adjustable mattress supporting device on which a mattress rests that defines the lying surface. Both side elements of the bed frame are mounted with grid-like safety side elements. Each of the safety side elements has a longitudinal bar extending in parallel to the relevant side element and above this side element, the bar being connected to the bed frame side elements through a plurality of mutually parallel connecting bars. All connections between the connecting bars, on the one hand, and the bed frame side element, as well as the longitudinal bar, on the other hand, are articulated and have pivot axles extending across the longitudinal extension of the bed. Thus, it is possible to lift and thereby pivot the safety side element into an upright position in which it projects upward beyond the lying surface, and to pivot it into a lowered position im which the longitudinal bar rests on the side element of the bed frame and is thus disposed below the lying surface so that a patient can readily get out of the bed.

The known safety side element structure has generally proven successful. However, its structure is rather complicated.

Further, medical beds are known from prior art wherein the safety side elements are disposed, according to the above structure, on the outside of the bed frame or the lying surface, respectively, the side elements of the bed frame or the lying surface, respectively, and the longitudinal bar being arranged on opposite sides of the connecting bars. Thus, it is possible to also pivot the safety side element downward to below the lying surface and, possibly, to below the bed frame.

From DE-U-17 18 671, a bed is known that is provided with lateral plates pivotally arranged below the lying surface and adapted to be folded up for use as a shield or screen. When those screen or shield plates are not needed, they are pushed underneath the lying surface from both sides and are stored there. The position of the plates of the known bed is more or less stable only when the plates are pushed in or folded up. As a consequence, the usefulness of the plates is limited to serving as a shield or a screen.

From DE-U-73 24 686, a children's bed is known where the side elements are provided at the bed frame adjustable in height. Finally, U.S. Pat. No. 5,381,571 describe a bed wherein a head-end safety side element and a foot-end safety side element are provided on each side of the lying surface. The gap between these two safety side elements can be closed with a third safety side element articulated to one of the two other safety side elements.

It is the object of the invention to provide a bed, in particular a medical or care bed, equipped with a safety side element of simpler structure and providing a safe support, which, in its function as a side element, is particularly suited for use in the care and the nursing of people lying in the bed.

To solve this object, the invention provides a bed, in particular a medical or care bed, comprising:

a lower frame having at least one leg or support element for support on a ground, an upper frame connected with the lower frame and having a head element and a foot element, as well as at least one connecting element connecting the same, a lying surface having two longitudinal edges extending between the head element and the foot element, and at least one safety side element supported in particular at the upper frame.

In the present bed, it is provided that the at least one safety side element is slidable, beneath the lying surface, in a pull-out plane, which is in particular substantially parallel to the lying surface, between an insert position, in which it is substantially flush with one of the longitudinal edges or offset inward therefrom, and a maximum pull-out position in which it protrudes outward beyond one of the longitudinal edges, that the at least one safety side element (preferably automatically) remains extending substantially in the pull-out plane in any intermediate position between (preferably including) the insert position and the maximum pull-out position, and that the at least one safety side element, in its maximum pull-out position, can be pivoted about a pivot axis substantially parallel to the longitudinal edges of the lying surface into an upright position in which the safety side element extends upward beyond the lying surface, a locking device fixing the at least one safety side element in the upright position against unintentional movement.

In the present bed, the safety side element, when not needed to laterally limit the lying surface, may be moved into a pull-out plane underneath the lying surface. Within this pull-out plane, the safety side element may be pulled out sideward from underneath the bed or it may be pushed sideward underneath the lying surface of the bed. This pull-out movement is limited by a maximum pull-out position. In this maximum pull-out position, the safety side element may be pivoted about a pivot axis extending substantially parallel to the lying surface, so as to be moved into its upright position. The pivot axis is disposed in the immediate vicinity of the lying surface so that the safety side element extends vertically upward when in the upright position close to the longitudinal edge of the lying surface. In the upright position, the safety side element is locked to the upper frame by an activatable and deactivatable locking device and, thus, is secured against unintentional movements.

The invention provides a structurally simple and still stable structure of a safety side element of a bed. The safety side element is extremely simple and reliable to operate. A particular advantage lies with the compact arrangement of the safety side element underneath the lying surface or underneath the upper frame of the bed considering the cleaning thereof and other manipulations, e.g., in caring for a patient. The area beneath the lying surface of the bed is freely accessible and is not obstructed by safety side elements. This allows to travel underneath the bed form the longitudinal sides, e.g., with a lift, a wheelchair, and the like, to transport a patient, this possibility of traveling underneath the bed also being given in the lowest height position of the bed (should it be provided with height adjustment means, e.g.).

The range of application of the safety side element is even enlarged by the fact that, in any of its pull-out positions, the safety side element is supported on the upper frame in a manner automatically secured against folding down or any other pivoting and/or tilting movements. This means that the safety side element is supported on the upper frame in the manner of a drawer or a pull-out tray. Pulling out the safety side element, the nursing staff can provide an additional depositing surface at the bed. This is again advantageous for the purpose of therapy or other nursing operations regarding the patient. Preferably, the pull-out plane extends substantially parallel to the lying surface.

In an advantageous development of the invention, the safety side element is locked automatically when moved into the upright position. This automatic locking may, for example, be effected by a pawl or a similar movable locking element engaging the safety side element.

An alternative to the previously described design of the locking device provides that it is activated automatically due to the dead weight of the safety side element. In this case, the safety side element, when fully pivoted upward, moves slightly downward due to its dead weight to insert the safety side element into locking blocking elements to secure it against unintentional pivoting. These blocking elements may either embrace the safety side element from the outside or enter the safety side element, for example, the frame structure thereof. The blocking elements extend vertically and are arranged on the upper frame.

Advantageously, the safety side element is locked (suitably automatically, especially by dead weight) against unintentional movement in the pull-out plane also in the insert position (as well as, in particular, in any pull-out position).

Within the scope of this invention, the automatic locking of each safety side element in both the upright position and the insert position, preferably by its own dead weight, has an independent relevance regardless of the other features of the present bed.

As mentioned above, it is advantageous to slidably guide the safety side element on the upper frame in the manner of a drawer. For this purpose, the head-end and the foot-end limiting edges of the safety side element are slidably guided in guiding profiles extending in parallel to the extension of the head-end and foot-end elements.

Conventional beds have each longitudinal edge provided with at least two safety side elements, one at the head-end and the other at the foot-end. With a mattress support device having an adjustable resting portion for the upper body, it is advantageous to have the head-end safety side element pivot along with the upper body resting portion, Therefore, it is feasible to mount the guiding profiles for the head-end safety side element on the mattress support device and, in particular, on the pivotable upper body resting portion. On the other hand, it is sufficient to support the foot-end safety side element at the bed frame, i.e., its guiding profiles are mounted on the foot-end element or the at least one connecting element connecting the foot-end and head-end elements. As an alternative, these foot-end safety side elements may also be supported at the relevant pivotable supporting portion of the mattress support device at the foot-end, so as to move along when the supporting portion is adjusted.

The guiding profiles are, in particular, C- or L-shaped profiles or profiles with a C- or L-shaped portion that laterally embrace the limiting edges of the safety side element.

With beds having a motor-powered adjustment of the mattress support device and a motor-driven height adjustment, the safety side element can be particularly well stored if all drive motors and transmission systems are centrally arranged in the midportion of the bed below the lying surface. In this case, there is sufficient space on both sides of the central drive and adjustment mechanism to store the safety side element or safety side elements without having to take into account any reinforcing elements for the upper frame or the mattress support device. The drive motors and transmission elements are suitably disposed centrally in a connecting element, designed as a central beam, for connecting the head-end and foot-end elements. Suitably, this connecting element is also engaged by the lower frame with its height adjustment. Above the central beam, the mattress support device is arranged and connected with the central beam. Thus, the central beam serves as the central structural element of the bed, connecting the lower frame with the upper frame and in particular with the mattress support device. This results in an advantageous design of the bed, both in view of the cleaning of the bed and its arrangement in separate structural and functional units.

The pull-out movement of the safety side element is limited by two cooperating stops or stop elements, the first stop element being provided on the safety side element, while the second stop element is provided on the upper frame. With the stops abutting, the safety side element may preferably be pivoted, the two stops together forming the pivot joint.

The above mentioned locking device for locking the safety side element in its upright position preferably engages the first stop. It is a particular advantage with a view to a simple design of the locking device to provide it as a recess into which the first stop can be sunk in the upright position of the safety side element, which is suitably effected by a downward movement of the safety side element caused by its own dead weight. The shape of the recess is complementary to the shape of the first stop so that the safety side element cannot be pivoted unintentionally when in its upright position. Preferably, the recess has a third stop against which the first stop abuts, thereby restricting the downward movement of the safety side element for moving the same into the locked state. Specifically, the recess is in the shape of a channel and has an open front end and an opposite closed end forming the third stop.

Preferably, the safety side element is adjustable in length to ensure a sufficiently large projection beyond the ly when a thicker mattress is used. Within the scope of the present invention, this is an independent feature. The safety side element comprises a pull-out element slidably attached to the frame part of the safety side element. The pull-out element can be fixed in its pull-out positions relative to the frame part.

Regardless of whether the safety side element is variable in length, it is feasible for it to have an exterior bar delimiting the side element upward when in the upright position. With the safety side element inserted, this bar is. preferably visible from outside and protrudes laterally beyond the relevant longitudinal edge of the bed. Optically, these bars of all safety side elements form the lateral limit of the lying surface and appear to be lateral frame elements interconnecting the head end and the foot end without being connected with either the head end or the foot end.

A mattress support device with adjustable support portions generally also comprises at least one stationary support portion besides the adjustable ones. This stationary support portion generally is the so-called gluteal support, whereas the upper body and the lower leg support portions each are adjustable. Providing safety side elements at the adjustable support portions of such a mattress support device is particularly feasible with respect to the upper body and the lower leg support portions.

In order to achieve the optical appearance of a lateral frame of the bed, it is advantageous for the stationary support portion and the upper leg support portion, generally not provided with a safety side element, to have lateral bars rigidly connected to these support portions and projecting sideward beyond the longitudinal edges of the lying surface. The design of these bars is similar to the outer bars of the safety side elements. Suitably, all of these bars (both of the support portions of the mattress support device that are stationary or not equipped with an safety side element and of the safety side elements) are provided with a yielding material, in particular plastics, so that a damage protection is provided on the longitudinal edges of the lying surface or the bed, respectively, serving to avoid damage when rolling the bed through door frames or the like. However, the bars may be made of another material (e.g. wood), the damage protection being less in this case. In the scope of the present invention, the above features are of independent importance without the other features being realized in the present bed.

It is suitable to provide two safety side elements at at least one longitudinal edge of the lying surface, the head-end safety side element extending to the head-end of the upper frame of the bed and the foot-end safety side element extending to the foot-end of the upper bed frame. A space is left between the two safety side elements, allowing a patient, for example, to leave the bed even with the safety side elements in their upright positions. To be able to secure this space as well, if need be, an advantageous embodiment of the invention, which is of independent meaning in the scope of this invention, provides for a third safety side element below the mattress support device guided at the same or at the lower frame, the third safety side element being adapted to be positioned upright like the other two safety side elements. As an alternative to providing a third safety side element, it is also possible to provide the foot-end or the head-end side elements with a respective closing element slidably supported at the respective safety side element and serving to close the space between the two safety side elements at least partly. In this development of the invention, it is further advantageous if the extensible closing element, slidable in parallel to the longitudinal edge of the lying surface, can be locked in its pull-out position. If only one of the safety side elements is provided with the closing element, it is advantageous for reasons of stability, to lock the pulled-out closing element at the respective other safety side element. There, a stop or a similar recess should advantageously be provided to increase the stability of the three-part safety side element arrangement.

Figure 2:
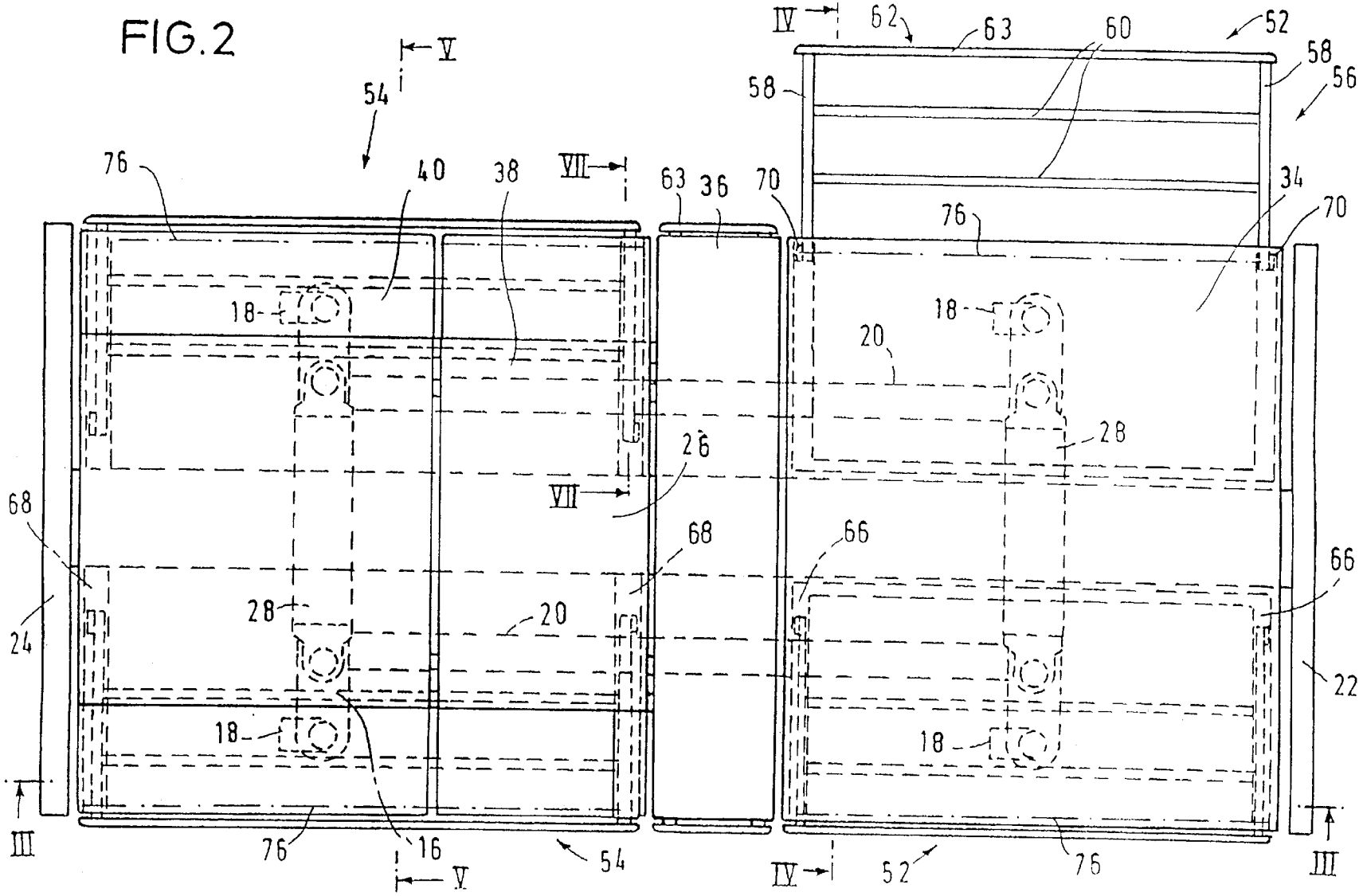
Figure 3:
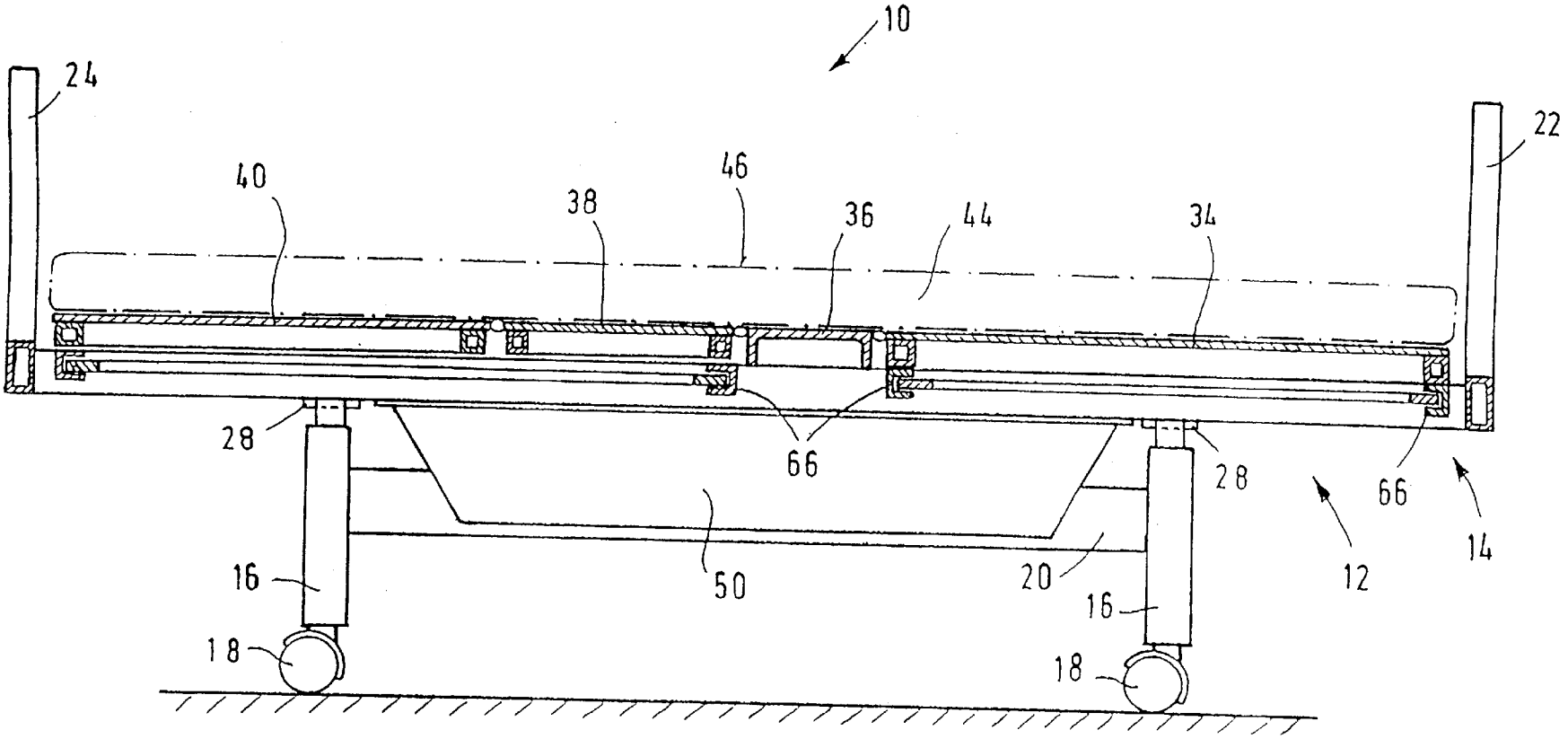
Figure 4:
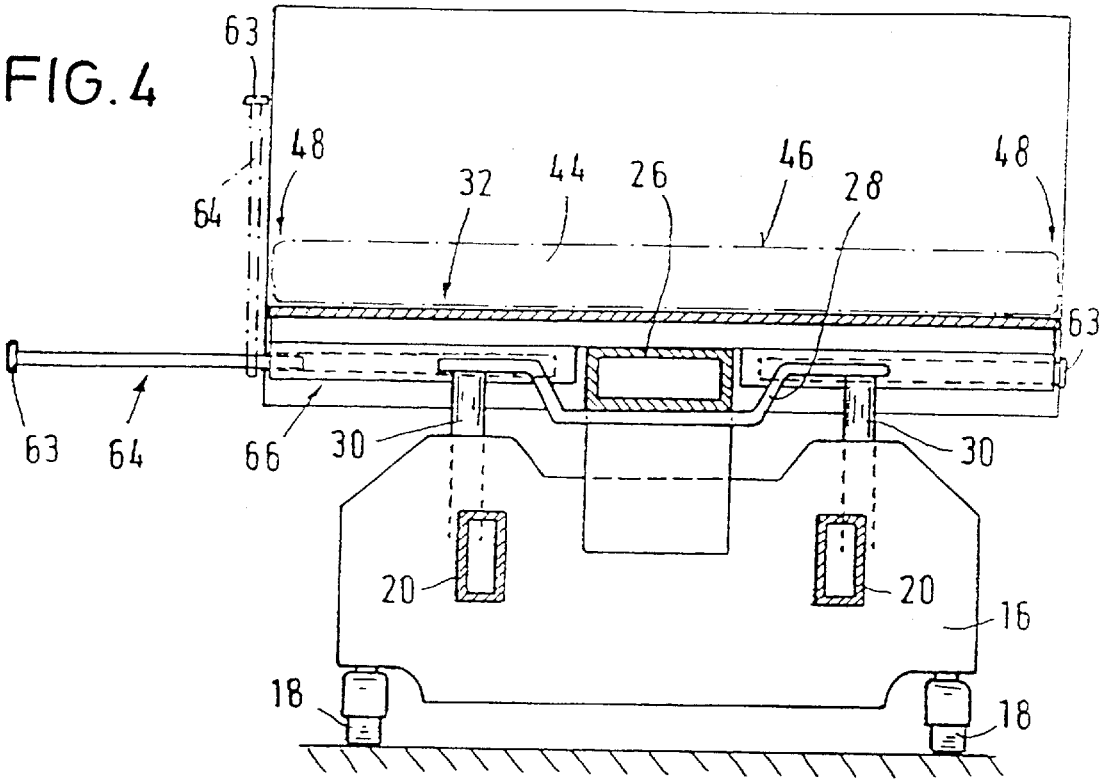
Figure 5:
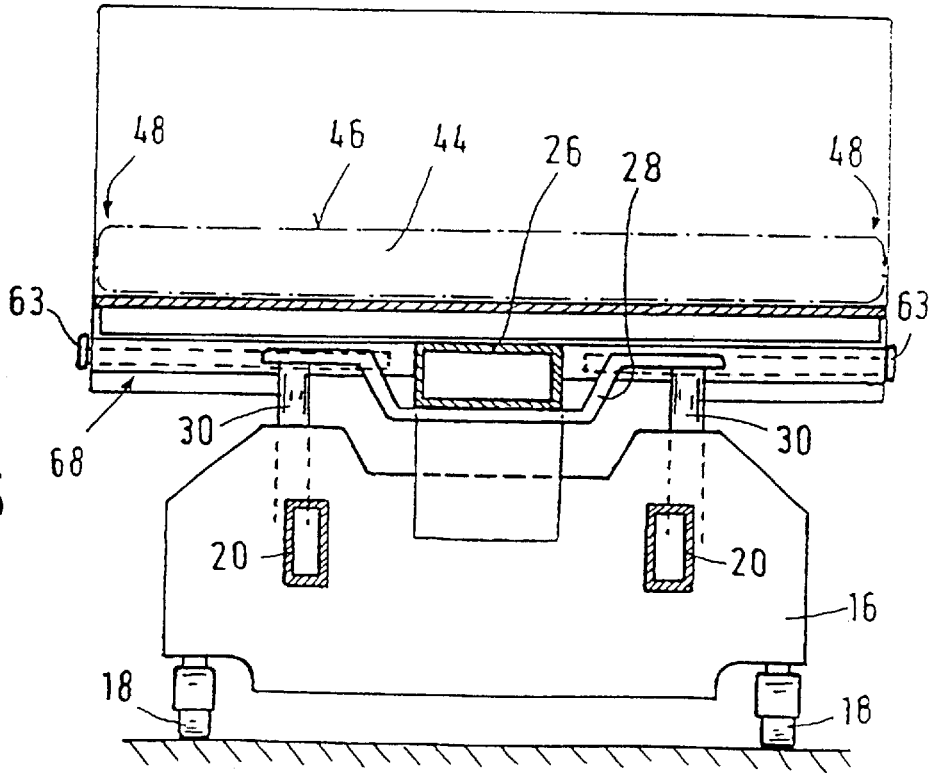
Figure 6:
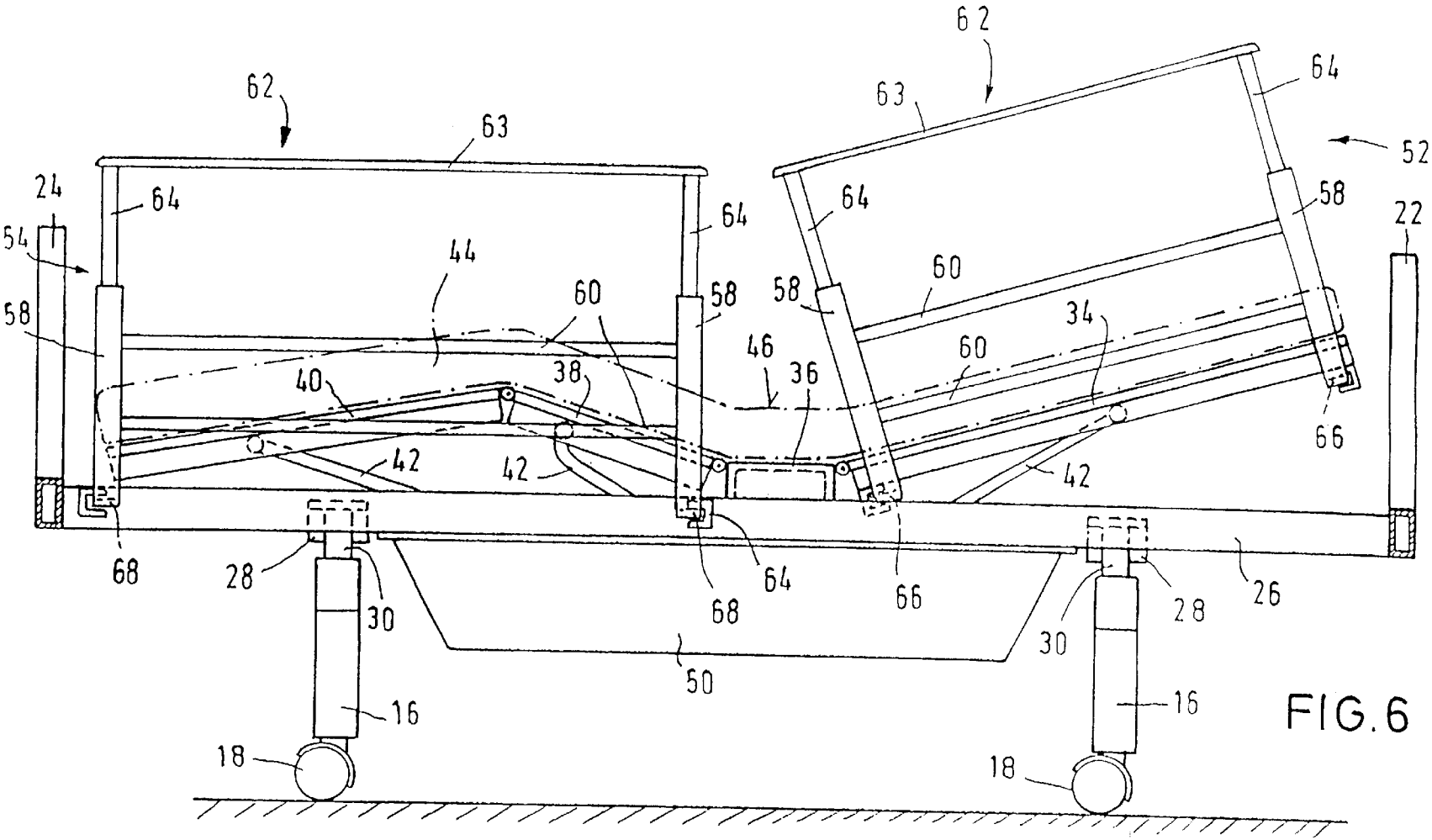
Figure 7:
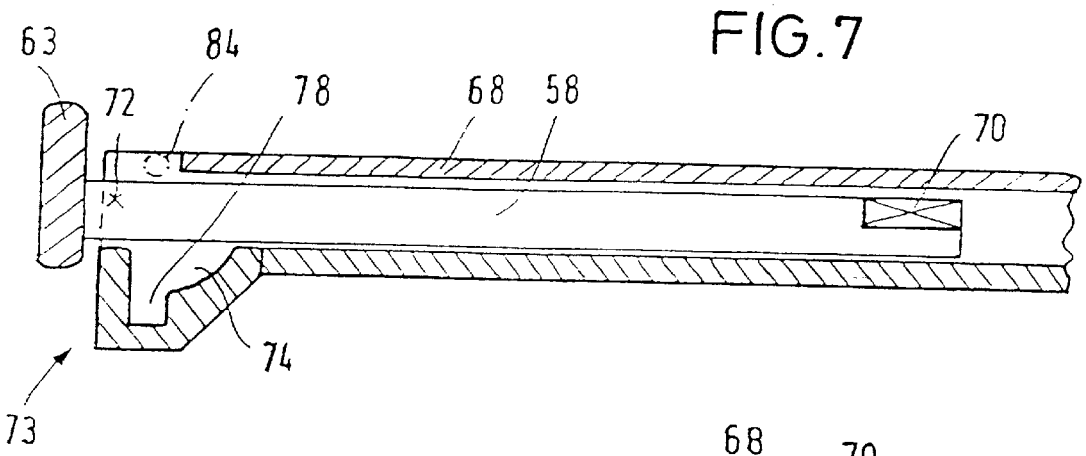
Figure 8:
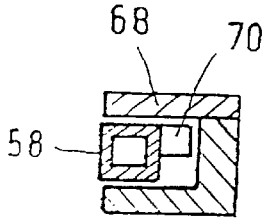
Figure 9:
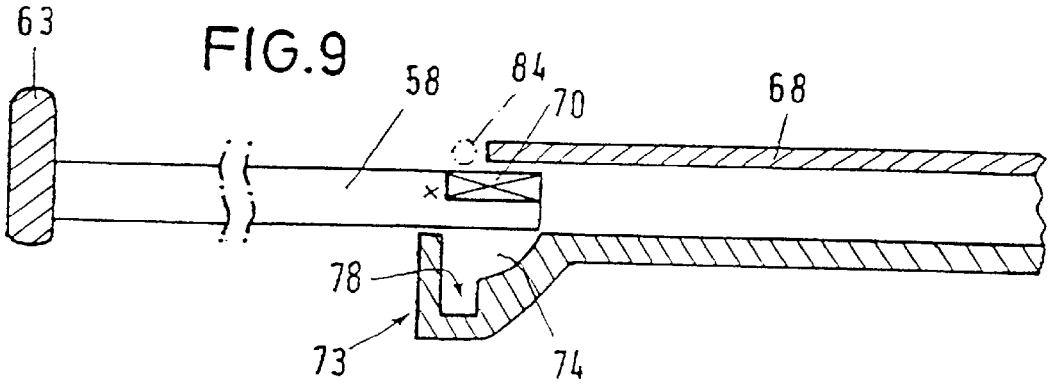
Figure 10:
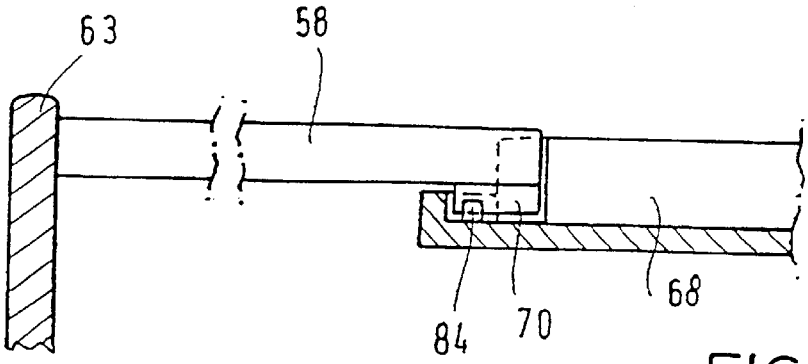
Figure 11:
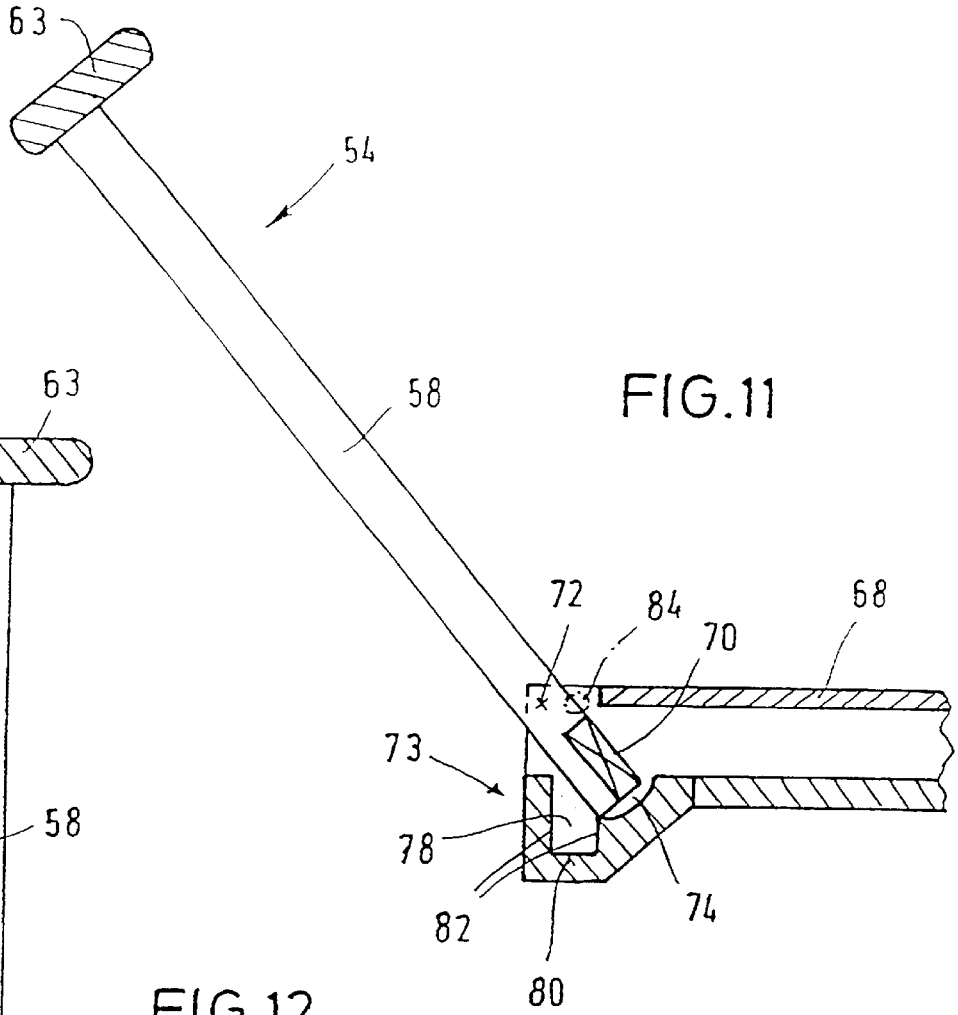
Figure 12:
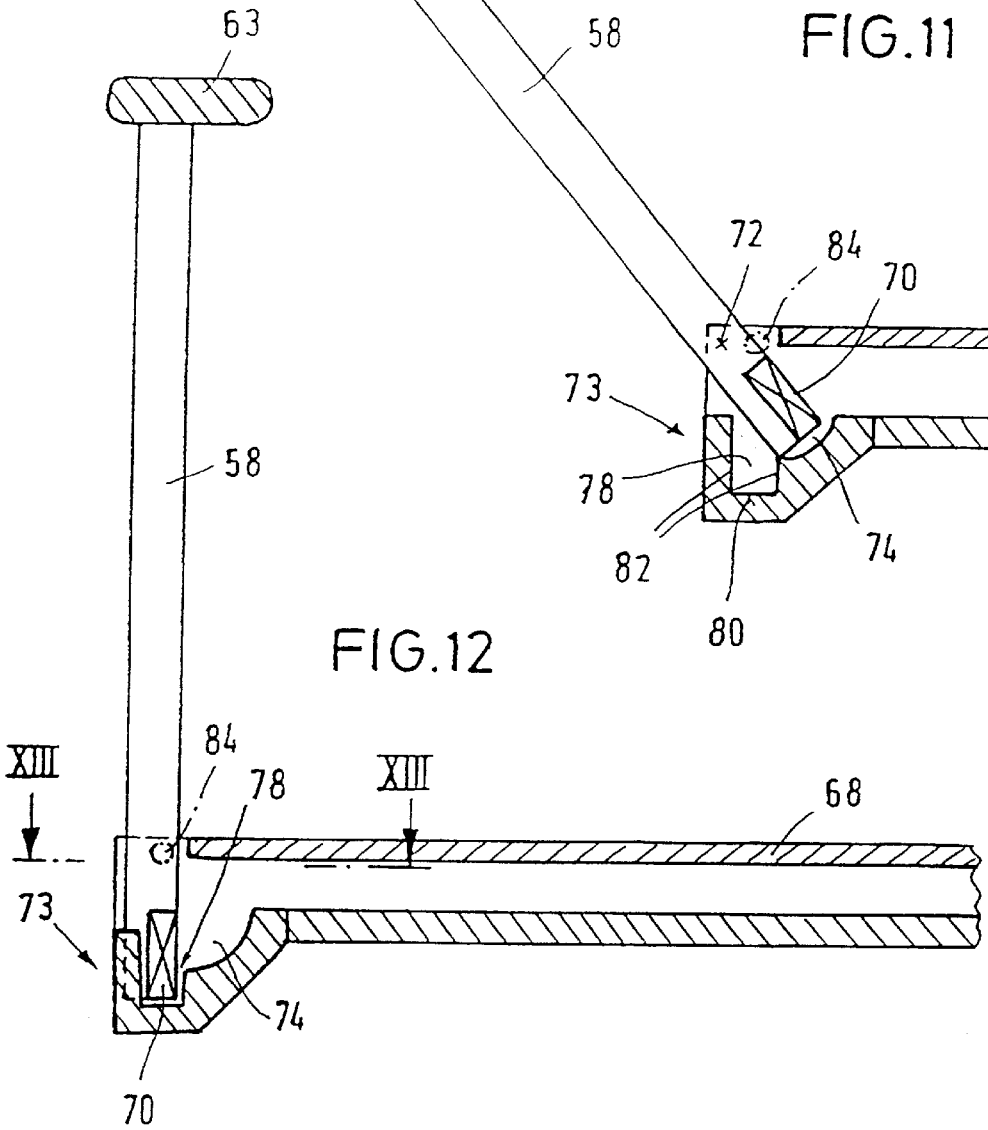
Figure 13:
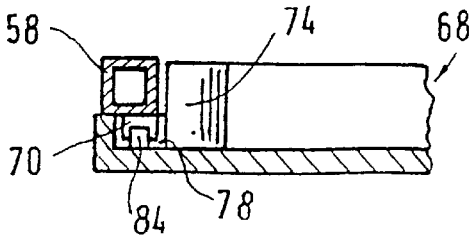
Figure 14:
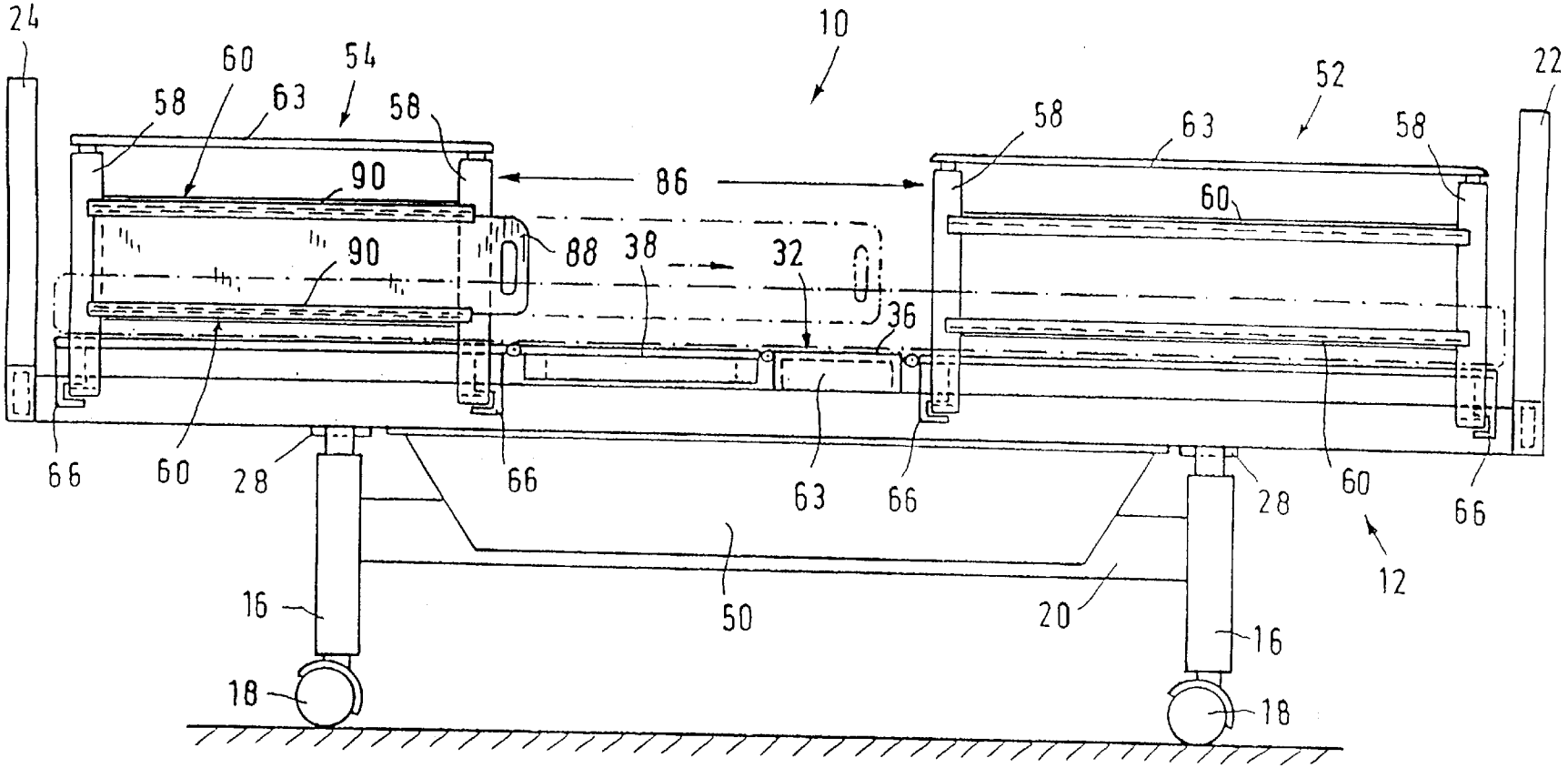
Figure 15:
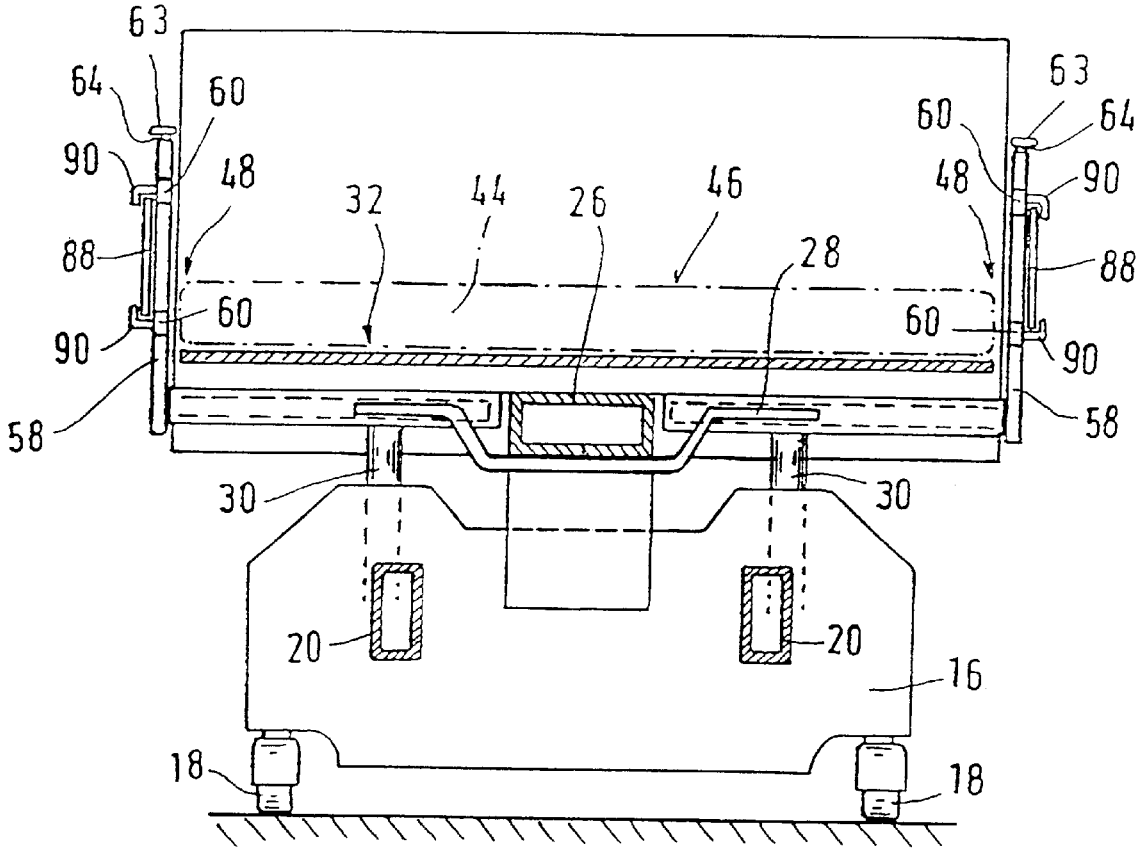

The following is a detailed description of an embodiment of the invention with reference to the drawings. In the Figures:

FIG. 1 is a perspective view of a bed according to a preferred embodiment of the invention, FIG. 2 is a plan view of the bed in the direction of the arrow II in FIG. 1 with the mattress removed, FIG. 3 is a sectional view along the line III—III in FIG. 2, FIG. 4 is a sectional view along the line IV—IV in FIG. 2, FIG. 5 is a sectional view along the line V—V in FIG. 2, FIG. 6 is a side elevational view of the bed of FIG. 1 with the safety side elements in their upright positions and the mattress support adjusted, FIG. 7 is a sectional view along the line VII—VII in FIG. 2, FIG. 8 is a sectional view along the line VIII—VIII in FIG. 7, FIG. 9 is a sectional view similar to that of FIG. 7, but with the safety side element fully pulled out, FIG. 10 is a sectional view along the line X—X in FIG. 10, FIGS. 11 and 12 are sectional view s similar to that of FIGS. 7 and 9 with the safety side element in different pivot positions and in the upright position, respectively, FIG. 13 is a sectional view along the line XIII—XIII in FIG. 12, FIG. 14 is a side elevational view of a bed according to another embodiment of the invention with an alternatively constructed foot-end safety side element, and FIG. 15 is a sectional view along the line XV—XV in FIG. 14.

FIG. 1 is a perspective view of a bed 10 which is a medical or care bed. The bed 10 is adjustable in height and comprises a lower frame 12 and an upper frame 14 arranged above the lower frame. The lower frame 12 has a head-end and a foot-end leg element 16 each provided with two rollers 18. The two leg elements 16 are connected through two connecting beams 20. The upper frame 14 has a headend element 22 and a foot end element 24 interconnected by a central bar 26 extending along the central axis (see, e.g., FIGS. 2 and 4, as well as 5). The central bar 26 is a hollow profile bar and extends transversely to two supporting beams 28 connected with extensible post elements 30 of the lower frame 12.

Above the central bar 26, a multi-part mattress support device 32 is arranged comprising a plurality of mattress support portions 34, 36, 38, 40, adjustable with respect to each other and movably connected between each other or to the central bar 26 through adjusting arms 42. The mattress support device 32 supports a mattress 44, the top surface of which forms the lying surface 46 defined in the longitudinal direction of the bed by longitudinal edges 48. The drive and adjustment mechanism (not illustrated in the Figs.) For the mattress support device 32 is provided in or at the central bar 26 in the central section thereof extending between the leg elements 16. In this section, the central bar 26 is provided with a cover 50 from below. As is particularly obvious from FIGS. 1 to 3 and 6, the upper frame 14 of the bed has two safety side elements 52, 54 at each longitudinal edge 48 of the support surface. The safety side elements 52 are arranged at the head-end, while the safety side elements 54 are arranged at the foot-end. Each safety side element consists of a frame part 56 with two lateral bars 58 and two transverse bars 60 connecting the former. The two lateral bars 58 extend in a plane parallel to both the head-end portion 22 and the foot-end portion 24, whereas the transverse bars 60 extend at right angles to these planes, i.e. in parallel to the longitudinal extension of the central bar 26 and, thus, the bed 10. The safety side elements 52, 54 are further provided with pull-out elements 62 extending parallel to the transverse bars 60. These pull-out elements 62 have insert arms 64 projecting from a bar 63 and received telescopically in the lateral bars 58 (illustrated only in FIGS. 6 and 14). The pull-out portions 62 are thus supported for withdrawal and insertion relative to the frame parts 56. In the inserted position of the associated safety side element 52, 54, the bar 63 forms the lateral limit of the bed 10 between the head-end and foot-end portions 22, 24. The bar 63 may be made of a yielding plastic material, serving as a damage protector for the bed 10. Such bars 63 or damage protectors are also arranged laterally of the stationary support portion 36 (e.g., the gluteal support) and a possibly provided, adjustable support portion of the mattress support device 32 (e.g. the upper leg support—not illustrated) that is not equipped with a safety side element.

The safety side elements 52, 54 are each guided along a pair of guiding profile bars 66, 68 extending transverse to the longitudinal direction of the bed 10 and, thus, transverse to the longitudinal extension of the central bar 26. All guiding profile bars 66, 68 are provided underneath the mattress support device 32. The guiding profile bars 66 for the head-end safety side elements 52 are mounted at the upper body support portion 34 of the mattress support device 32 at the head-end, while the guiding profile bars 68 for the safety side elements 54 at the foot-end project laterally from the central bar 26.

As illustrated in the Figures, the safety side elements 52, 54 can be pulled out sideward from the upper frame beyond the longitudinal edges 48 of the lying surface 46. In all of these pull-out positions (except the maximum pull-out position), the safety side elements are supported on the guiding profile bars 66, 68 in a manner secured against pivoting, by making the guiding profile bars embracing the lateral bars 58 of the safety side elements 52, 54 in a C-shaped manner.

The pull-out movement of the safety side elements 52, 54 is limited by cooperating stop elements on the side elements and the guiding profile bars. The safety side elements 52, 54 have the opposite outer surfaces of their lateral bars 58 provided with elongate stops 70 of rectangular section (see, e.g., FIG. 2) formed with stop elements 72 on the outer ends 73 of the guiding profile bars 66, 68. As illustrated in particular in the FIGS. 7 to 13, the guiding profile bars 66, 68 have pockets 74 at their outer free ends, into which pockets the stops 70 of the lateral bars 58 plunge when the side elements 52, 54 are pivoted upward in the maximum pull-out position. The pockets 74 are disposed at the guiding profile bars 66, 68 below the lateral bars 58. These pocket-shaped recesses 74 allow the safety side elements 52, 54 to be pivoted relative to the guiding profile bars 66, 68, it being further necessary that the stop elements 70 of the safety side elements 52, 54 are provided on the ends averted from the pull-out elements 62. In this manner, with the side elements 52, 54 fully pulled out, a respective pivot joint is obtained between the side elements and the guiding profile bars 66, 68, the joint having a pivot axis 76 extending in parallel to the lying surface. 46.

Channel-shaped locking recesses 78 end in the receiving pockets 74, the stop elements 70 plunging into the recesses, when the relevant safety side element 52, 54 is pivoted vertically upward and sinks down due to its dead weight. These locking recesses 78 are vertically oriented and closed at their bottom end 80 so that a stop element is created that cooperates with the stop element 70 and defines the downward movement of the respective safety side element 52, 54. The parallel lateral limits 82 of the locking recesses 78 extend along both sides of the first stop elements 70, whereby the safety side elements 52, 54 are secured against unintentional pivoting when in their vertically oriented upright positions. In their upright position (see FIGS. 4, 6 and 12), the safety side elements 52, 54 are secured against unintentional removal from the guiding profile bars 66, 68 by blocking bolts 84 mounted thereon, which are arranged in projection of the longitudinal extension of the locking recesses 78 and cooperate with the stop elements 70 of the safety side elements 52, 54.

The safety side elements 52, 54 described herein may be displaced below the lying surface 46 of the bed 10 in a plane substantially parallel thereto and may thus be pulled out sideward from under the bed 10. This provides additional deposition area besides the ly 46 to be used for therapeutic purposes, treatment purposes or for nursing the patient. By pivoting up the fully pulled-out safety side elements 52, 54, these may be brought into their upright positions, in which they become locked automatically due to a slight downward movement caused by their dead weight, and in which they project upward beyond the lying surface 46. The operation of the safety side elements 52, 54 is as simple as can be, their being stored displaceably under the is 46 is saving space and advantageous with a view to the cleaning of the bed, since they do not obstruct the area below the lying surface or the mattress support device (see, in particular, FIGS. 4 and 5).

FIG. 14 shows a side elevational view of a bed 10' with an alternative deign of the foot-end safety side element 54. In as far as the elements of the bed 10' are identical, similar or functionally adequate to the elements of the bed 10 of FIGS. 1 to 13, they have been accorded the same reference numerals.

In the same manner as the head-end safety side element 52, the foot-end safety side element 54 of the bed 10' is mounted to the lower leg support 40 of the mattress support device 32. Thus, he foot-end safety side element 54 no longer extends along both support portions 38, 40 of the mattress support device 32 that point towards the foot-end portion 24. Thus, a space 86 is obtained between the two safety side elements 52, 54, in which the lying surface 46 is not limited laterally by an upright safety side element. This space 86 is advantageous in that the patient can leave the bed when the safety side elements 52, 54 are in their upright positions.

In order to obtain a lateral limit of the lying surface 46 also in the area of the space 86, the foot-end safety side element 54 is provided with a closing element 88 to be pulled out towards the head- end 52, the closing element being a plate in the present embodiment. The plate 88 may be pushed up to the safety side element 52 where it abuts against a stop or a similar receptacle not illustrated for simplicity. As is particularly evident from FIG. 15, the plate 88 is slidably supported on the transverse bars 60 of the frame part 56 of the foot-end safety side element 54, i.e. at the outer sides thereof. On these outer sides, the transverse bars 60 comprise embracing elements 90 embracing the upper and lower edges of the plate 88 extending parallel to the longitudinal edges of the lying surface 46. The plate 88 may be adapted to be locked in its pull-out positions at the foot-end safety side element 54. Finally, it is also conceivable to also provide the head-end safety side element 52 with such a closing element 88 to close the space 86 from both safety side elements 52, 54 by moving the plates 88 towards each other.

As an alternative to the design of the closing elements 88 as a plate, the closing element 88 may also be shaped as a substantially U-shaped bracket, the parallel lateral legs thereof being telescopically guided within the two transverse bars 60 of the respective safety side element 52, 54, and the base portion thereof, connecting the both parallel lateral legs, faces the space 86 when withdrawn.

What is claimed is:

1. A medical care bed, comprising:

a lower frame having at least one leg or support element for support on a floor;

an upper frame connected with the lower frame and having a head element and a foot element, as well as at least one connecting element interconnecting the head and foot elements;

a lying surface having two longitudinal edges extending between the head element and the foot element;

at least one safety side element being slidable, beneath the lying surface in a pull-out plane between an insert position, in which it is substantially flush with one of the longitudinal edges or offset inward therefrom, and a maximum pull-out position in which it protrudes outward beyond one of the longitudinal edges;

the at least one safety side element being supportable in the pull-out plane in any intermediate position between the insert position and the maximum pull-out position; and when the at least one safety side element is at the maximum pull-out position, the at least one safety side element is pivotable about an axis substantially parallel to the longitudinal edges of the lying surface into an upright position in which the at least one safety side element extends upward beyond the lying surface.

2. The bed of claim 1, further comprising a plurality of safety side elements and a mattress support device with a plurality of adjustable support portions, in particular a head-end and a foot-end adjustable support portion, wherein the plurality of safety side elements are supported for displacement and pivoting on both sides of each support portion.

3. The bed of claim 2, further comprising guiding profiles mounted to the head element, the foot element, the connecting element connecting the head element with the foot element, and/or the mattress support device for supporting a mattress forming the lying surface.

4. The bed of claim 1, wherein the at least one safety side element is automatically locked against unintentional pivoting, when in an upright position, and in its insert position.

5. The bed of claim 4, wherein while being pivoted for movement into the upright position, the at least one safety side element when in the pull-out position, automatically assumes the locked state due to a dead weight thereof in which it is locked by a locking means.

6. The bed of claim 5, wherein the at least one safety side element further comprises a head-end and a foot-end limiting edge at which it is slidably guided in guiding profiles extending in the pull-out plane and in parallel to an extension of the head element and the foot element.

7. The bed of claim 6, wherein the guiding profiles have shaped sections to partly embrace limiting edges of the at least one safety side element.

8. The bed of claim 7, wherein at least one first stop is provided on one of the limiting edges of the at least one safety side element, and wherein a second stop and a third stop are arranged on the guiding profiles associated with the limiting edges of the at least one safety side element.

9. The bed of claim 6, further comprising a plurality of safety side elements and a mattress support device with a plurality of adjustable support portions, in particular a head-end and a foot-end adjustable support portion, wherein the plurality of safety side elements are supported for displacement and pivoting on both sides of each support portion.

10. The bed of claim 2, wherein the at least one adjustable support portion further comprises bars extending substantially parallel to the head and foot elements.

11. The bed of claim 11, wherein the at least one first stop is an elongate element, and wherein the recess of the locking device is in a shape of a channel which matches a shape of the at least one first stop.

12. The bed of claim 11, wherein the channel-shaped recess of the locking device has an open end and an opposite closed end and wherein the closed end forms a third stop.

13. The bed of claim 1, wherein the at least one safety side element has at least one first stop limiting the pull-out movement in the pull-out position, the at least one first stop cooperating with a second stop on the upper frame.

14. The bed of claim 13, wherein the at least one safety side element is pivotable about its pivot axis when the first and second stops abut.

15. The bed of claim 13, further comprising a locking device, the locking device engaging the at least one first stop in the upright position of the at least one safety side element.

16. The bed of claim 15, wherein the locking device has a recess in which the at least one first stop is received in the upright position of the at least one safety side element.

17. The bed of claim 1, wherein a locked state of the at least one safety side element is defined by cooperation with a stop provided on the upper frame.

18. The bed of claim 1, wherein the at least one safety side element has an outer bar that, in the insert position of the at least one safety side element, protrudes outward beyond the longitudinal edges of the lying surface.

19. The bed of claim 18, wherein the outer bar comprises an elastic plastic material.

20. The bed of claim 1, wherein the at least one safety side element further comprises a frame portion slidably guided in the pull-out plane, and a pull-out element connected to the frame portion, which forms the end of the at least one safety side element averted from the lying surface when the safety side element is in the maximum pull-out position and/or the upright position.

21. The bed of claim 20, wherein the pull-out element is adapted to be slidably guided at and locked to the frame portion.

22. The bed of claim 20, wherein the pull-out element of the at least one safety side element comprises an outer bar, wherein the insert position of the at least one safety side element protrudes outward beyond the longitudinal edges of the lying surface.

23. The bed of claim 22, wherein the outer bar comprises an elastic plastic material.

24. The bed of claim 1, further comprising two safety side elements separated by a space along at least one of the longitudinal edges of the lying surface, wherein one of the safety side elements is arranged at the head-end and the other is arranged at the foot end.

25. The bed of claim 24, further comprising a third safety side element provided in the space.

26. The bed of claim 24, further comprising a closing element guided at the head-end and/or the foot-end safety side element, the closing element being adapted to be slid into the space parallel to the longitudinal edge of the lying surface and to be locked in the space.

27. The bed of claim 1, wherein a locking device fixes the at least one safety side element in the upright position against unintentional movement.

28. The bed of claim 1, further comprising a mattress support device for supporting a mattress defining the lying surface, the mattress support device having at least one adjustable support portion at which the at least one safety side element is supported for displacement and pivoting.

29. The bed of claim 1, further comprising a mattress support device for supporting a mattress defining the lying surface, the mattress support device having at least one adjustable support portion at which the at least one safety side element is supported for displacement and pivoting.

30. A medical care bed, comprising:

a lower frame having at least one leg or support element for support on a floor;

an upper frame connected with the lower frame and having a head element and a foot element, as well as at least one connecting element interconnecting the head and foot elements;

a lying surface having two longitudinal edges extending between the head element and the foot element;

at least one safety side element being slidable, beneath the lying surface in a pull-out plane between an insert position, in which it is substantially flush with one of the longitudinal edges or offset inward therefrom, and a maximum pull-out position in which it protrudes outward beyond one of the longitudinal edges;

the at least one safety side element has at least one first stop limiting the pull-out movement in the pull-out position, the at least one first stop cooperating with a second stop on the upper frame;

the at least one safety side element being supportable in the pull-out plane in any intermediate position between the insert position and the maximum pull-out position; and when the at least one safety side element is at the maximum pull-out position, the at least one safety side element is pivotable about an axis substantially parallel to the longitudinal edges of the lying surface into an upright position in which the at least one safety side element extends upward beyond the lying surface.

31. A medical care bed, comprising:

a lower frame having at least one leg or support element for support on a floor;

an upper frame connected with the lower frame and having a head element and a foot element, as well as at least one connecting element interconnecting the head and foot elements;

a lying surface having two longitudinal edges extending between the head element and the foot element;

at least one safety side element being slidable, beneath the lying surface in a pull-out plane between an insert position, in which it is substantially flush with one of the longitudinal edges or offset inward therefrom, and a maximum pull-out position in which it protrudes outward beyond one of the longitudinal edges;

a mattress support device for supporting a mattress defining the lying surface, the mattress support device having at least one adjustable support portion at which the at least one safety side element is supported for displacement and pivoting;

the at least one safety side element being supportable in the pull-out plane in any intermediate position between the insert position and the maximum pull-out position; and when the at least one safety side element is at the maximum pull-out position, the at least one safety side element is pivotable about an axis substantially parallel to the longitudinal edges of the lying surface into an upright position in which the at least one safety side element extends upward beyond the lying surface.

* * * * *